US006568803B2

(12) United States Patent
Salim et al.

(10) Patent No.: US 6,568,803 B2
(45) Date of Patent: May 27, 2003

(54) PRINT MEDIA HANDLING AND EJECTION SYSTEM

(75) Inventors: Senarto Salim, Singapore (SG); Kong Hock Lim, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/106,679

(22) Filed: Mar. 25, 2002

(65) Prior Publication Data

US 2003/0076398 A1 Apr. 24, 2003

(30) Foreign Application Priority Data

Oct. 19, 2001 (SG) ..... 200106487

(51) Int. Cl.[7] ..... B41J 2/01; B41J 29/13
(52) U.S. Cl. ..... 347/104; 347/108
(58) Field of Search ..... 347/108, 104, 347/2, 3; 400/602, 624, 625, 628, 629, 635, 642, 649; 271/109, 225, 272, 264, 275, 4.04

(56) References Cited

U.S. PATENT DOCUMENTS 4,262,894 A * 4/1981 Marano ..... 271/4
5,730,537 A 3/1998 Kelly et al. ..... 400/625
6,464,350 B1 * 10/2002 Uchida ..... 347/104

* cited by examiner

*Primary Examiner*—John Barlow
*Assistant Examiner*—An H. Do

(57) ABSTRACT

An inkjet printer includes an inkjet cartridge having a printhead at which ink is ejected onto a media sheet, and a substantially horizontally slidable support adjacent to the cartridge. The support is substantially horizontally slidable between a first position in which the support supports a portion of the media sheet when the media sheet is printed and fed toward a media output area, and a second position in which the media sheet is free to move to the media output area.

8 Claims, 5 Drawing Sheets

PRINT MEDIA HANDLING AND EJECTION SYSTEM

BACKGROUND OF THE INVENTION

This invention relates generally to inkjet printers, and more particularly to media handling and ejection system.

U.S. Pat. No. 5,730,537 ('537), issued to Kieran B. Kelly et al. and assigned to Hewlett-Packard Company, discloses a print media handling and ejection system and is incorporated herein by reference.

In particular, '537 discloses a pair of rail extensions above an output stack for supporting a media sheet as the media sheet is being printed. The rail extensions can rotate between a down, extended position and an up, retracted position. When the printing job is over, the rail extensions are rotated upward from the extended position to the retracted position, and the printed media sheet is free to move into an output tray.

Nowadays, printers in high printing volume scenarios desire high output capacity. In '537, the rail extensions sweep down toward the output stack when they are activated. Hence the lowest point of the rail extensions in their extended positions limits the height of the output stack. In order to achieve a desired output capacity, an extra height is needed for accommodating the rail extensions of '537 when they are retracted. Such an extra height may not be desirable for printers due to the limited space in printers.

SUMMARY OF THE INVENTION

According to the invention, an inkjet printer includes an inkjet cartridge having a printhead at which ink is ejected onto a media sheet and a substantially horizontally slidable support adjacent to the inkjet cartridge. The support is substantially horizontally slidable between (1) a first position in which the support supports a portion of the media sheet when the media sheet is printed and fed toward a media output area and (2) a second position in which the media sheet is free to move to the media output area.

In one aspect of the invention, the printer includes a support frame mounted on the printer, and the support frame has a rail along which the support moves substantially horizontally. In one embodiment of the invention, the support includes a tongue for resting on and moving along the rail.

Ideally, a print zone within which ink is printed onto the media sheet occurs between the printhead and the support. Furthermore, the output area has an output tray, and the support has a rail support mechanism which is located above the output tray and extends in the output area away from the print zone.

In another aspect of the invention, the printer includes a driver for transferring a rotational driving force into a linear driving force such that the support is driven to move substantially horizontally between the first and the second positions.

In the preferred embodiment, the driver has a rotatable shaft for receiving the rotational driving force and an actuator which is connected to the shaft and extends away from the shat for driving the support to move substantially horizontally. In addition, the support has a sleeve for receiving the actuator.

Other aspects and advantages of the invention will become apparent from the following detailed description taken in conjunction with the accompanying drawings, which illustrate by way of example the principles of the invention.

DETAILED DESCRIPTION OF THE INVENTION

Figure 1:
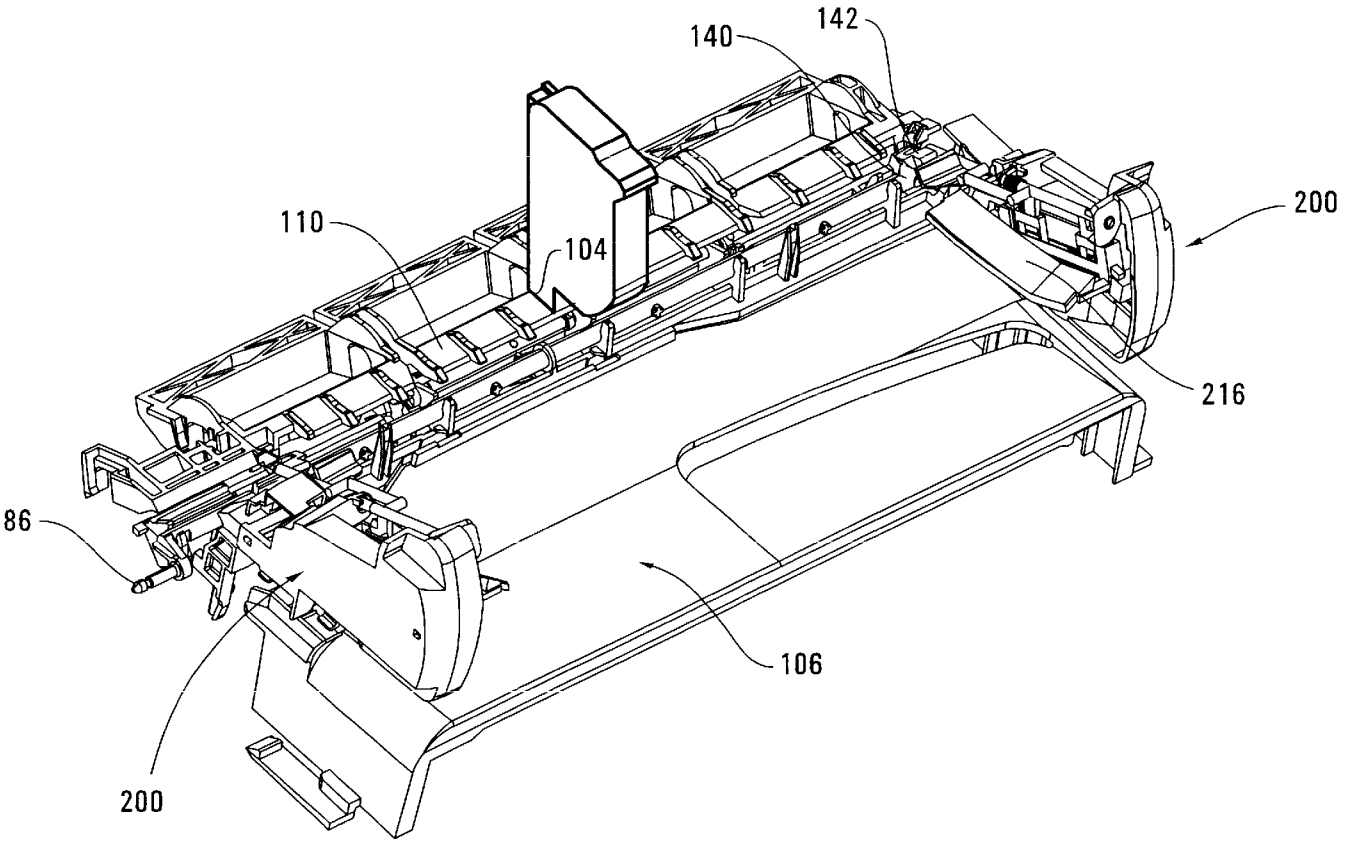
FIG. 1 illustrates a portion of an inkjet printer having a pivot mechanism in a first position and rail extensions in a deactivated position according to an embodiment of the invention.

FIG. 1 shows a portion of an inkjet printer having a platen 110, a rotatable pivot mechanism 86 and a pair of rail extensions 200 above an output area 106.

As shown in FIG. 1, both the platen 110 and the pivot mechanism 86 are perpendicular to the media path along which a media sheet is advanced during printing. In this embodiment, the platen 110 is mounted on the printer frame structure (not shown) and is immovable in the printer. A print zone (not shown) is formed between the support surface of the platen 110 and the inkjet cartridge's printhead 104 when the printhead 104 prints to a media sheet (not shown).

The pivot mechanism 86 is coupled to a kick/pick transmission (not shown) through a link (not shown). The transmission is disengagably linked to a gear transmission (not shown) via a rocking mechanism (not shown) and drives the gear transmission. A drive motor (not shown) is coupled to the gear transmission and drives the gear transmission. A feed roller (not shown) driven by the motor via the gear transmission feeds the media sheet towards the print zone during printing. The pivot mechanism 86 is driven by the motor when the rocking mechanism engages the kick/pick transmission to the gear transmission. Such a driving mechanism is disclosed in detail in '537.

Figure 2:
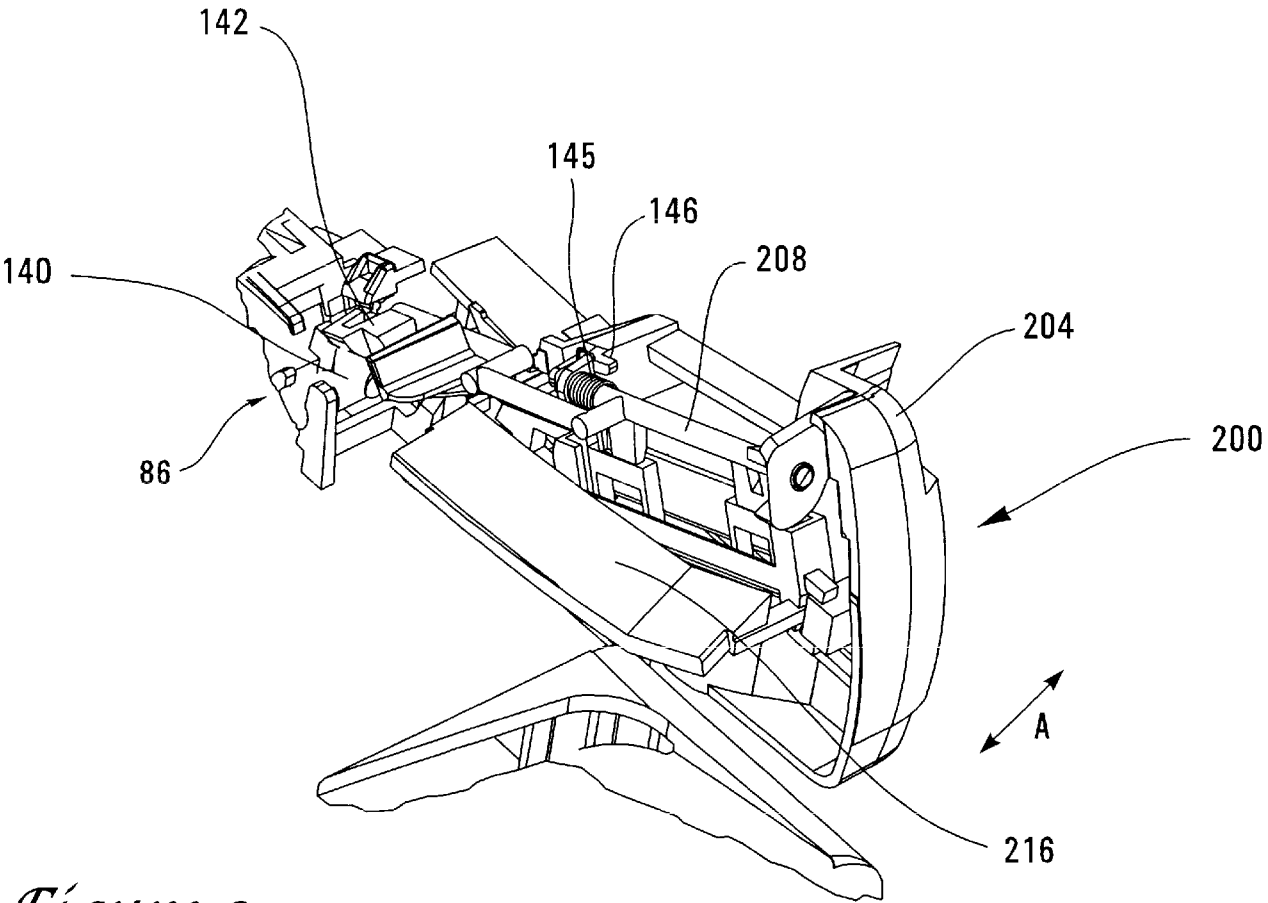
FIG. 2 illustrates a close-up view of one of the rail extensions of FIG. 1.

In addition, the pivot mechanism 86 includes two end portions 140 at each respective end as shown in FIG. 2. Each end portion 140 extends into contact with a lever portion 142 of the respective rail extension 200. When the pivot mechanism 86 is in its first position as shown in FIG. 1, the rail extension 200 stays in a deactivated position, and the end portion 140 is under the respective lever portion 142. As the pivot mechanism 86 rotates upward, the end portion 140 pushes the respective lever portion 142 upward. Such a rotational force on the lever portion 142 drives the respective rail extension 200 toward an activated position, which will be discussed in more detail.

Figure 5:
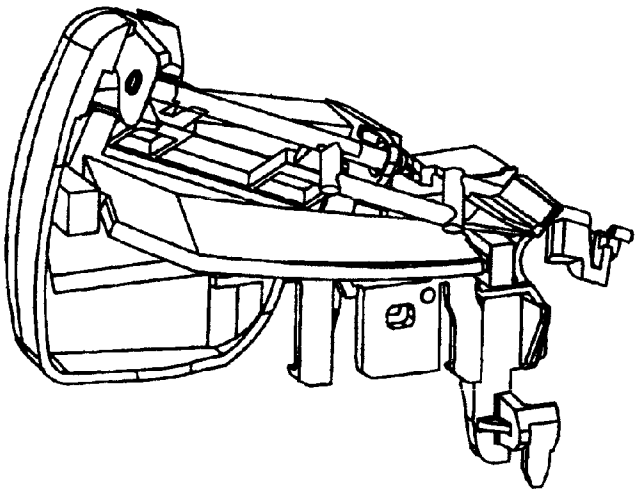
FIGS. 4 and 5 illustrate one of the rail extensions of FIG. 1 in activated and deactivated positions respectively.

FIG. 2 is a close-up view of one of the rail extensions. Each rail extension 200 has a rotatable cam shaft 208 at an end of which the lever portion 142 is located. Such a cam shaft 208 is to receive the rotational force from the lever portion 142. In addition, a coil spring 145 mounted on the cam shaft 208 is provided with an extended pin-like portion 147 (see FIG. 3) for attaching to a projection 146 on a support frame 204 of the rail extension 200. With such a spring mechanism, the rail extension 200, especially a wing 216 of the rail extension 200, is biased towards the deactivated position as shown in FIG. 5 when the pivot mechanism 86 stays in its first position as shown in FIG. 1. Only when the lever portion 142 is pushed upward by the respective end portion 140 of the pivot mechanism 86, the rail extension 200 is driven to the activated position which is shown in FIG. 4.

Figure 3:
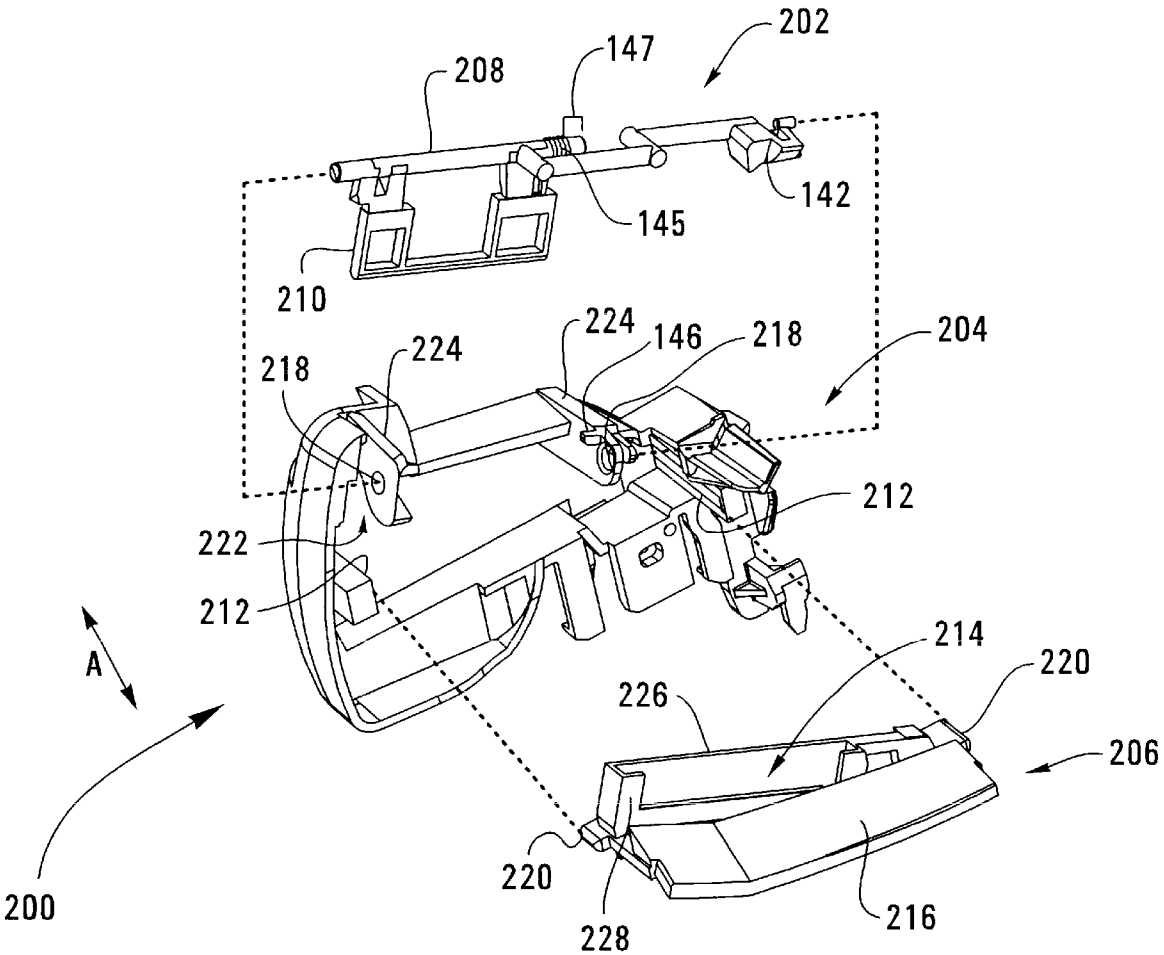
FIG. 3 is an exposure view of one of the rail extensions of FIG. 1.
Figure 4:
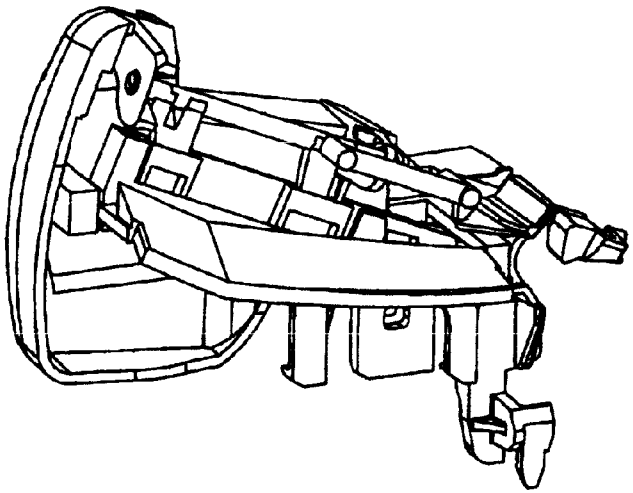

As shown in FIG. 3, each rail extension 200 of the invention includes a driver 202, the support frame 204 for mounting the rail extension 200 on the printer, and a support such as a wing structure 206.

The driver 202 mainly includes the cam shaft 208, the lever portion 142 mounted at an end of the cam shaft 208, the coil spring 145 and an activator 210 connected to the cam shaft 208. The cam shaft 208 receives the rotational driving force from the lever portion 142. When the lever portion 142 rotates about its axis as it is driven by the respective end portion 140, the activator 210 is also driven to rotate accordingly.

The support frame 204 has a wall 222 that extends away from the print zone. A pair of apertures 218 for receiving the cam shaft 208 are respectively formed on a pair of arms 224 which extend from the wall 222. The arms 224 and the apertures 218 are configured such that when the rail extension 200 is assembled, the cam shaft 208, which goes through the apertures 218 as shown by dot lines in FIG. 3, extends substantially parallel to the wall 222. The support frame 204 also has a pair of substantially straight rails 212 which are parallel to each other and which extend from the wall 222 substantially horizontally. A space between the pair of rails is provided for receiving the wing structure 206. When the rail extension 200 is assembled, the wing structure 206 rests atop the pair of rails 212; during printing operations, the wing structure 206 linearly slides along the rails 212.

The wing structure 206 includes (1) a sleeve 214 located at a side of the wing structure 206 for receiving the activator 210 and (2) a pair of tongues 220 for resting atop and sliding along the pair of rails 212. Once assembled, the tongues 220 are restricted to moving along the rails 212. In addition, the sleeve 214 has a pair of blades 226, 228 which are substantially parallel to the wall 222. One of them, the inner blade 226 is located adjacent to the wall 222, while the other, the outer blade 228 is located away from the wall 222.

The wing structure 206 further includes the wing 216 acting as a rail support mechanism in the embodiment. The wing is above an output tray (not shown) in the output area 106 and extends in the output area 106 away from the print zone. Each wing 216 of the two rail extensions supports at least a portion of a media sheet (not shown) during printing.

The sleeve 214, the tongues 220 and the wing 216 are connected to each other, and the tongues are respectively located at two ends of the wing 216 in a direction away from the print zone.

Further, the actuator 210 is loosely fitted into the sleeve 214. When the actuator 210 rotates as driven by the cam shaft 208, the actuator 210 pushes a blade of the sleeve 214 such that the wing structure 206 is driven to slide along the rails 212 linearly, i.e., substantially horizontally, as indicated by arrow A in FIGS. 2 and 3.

Figure 6:
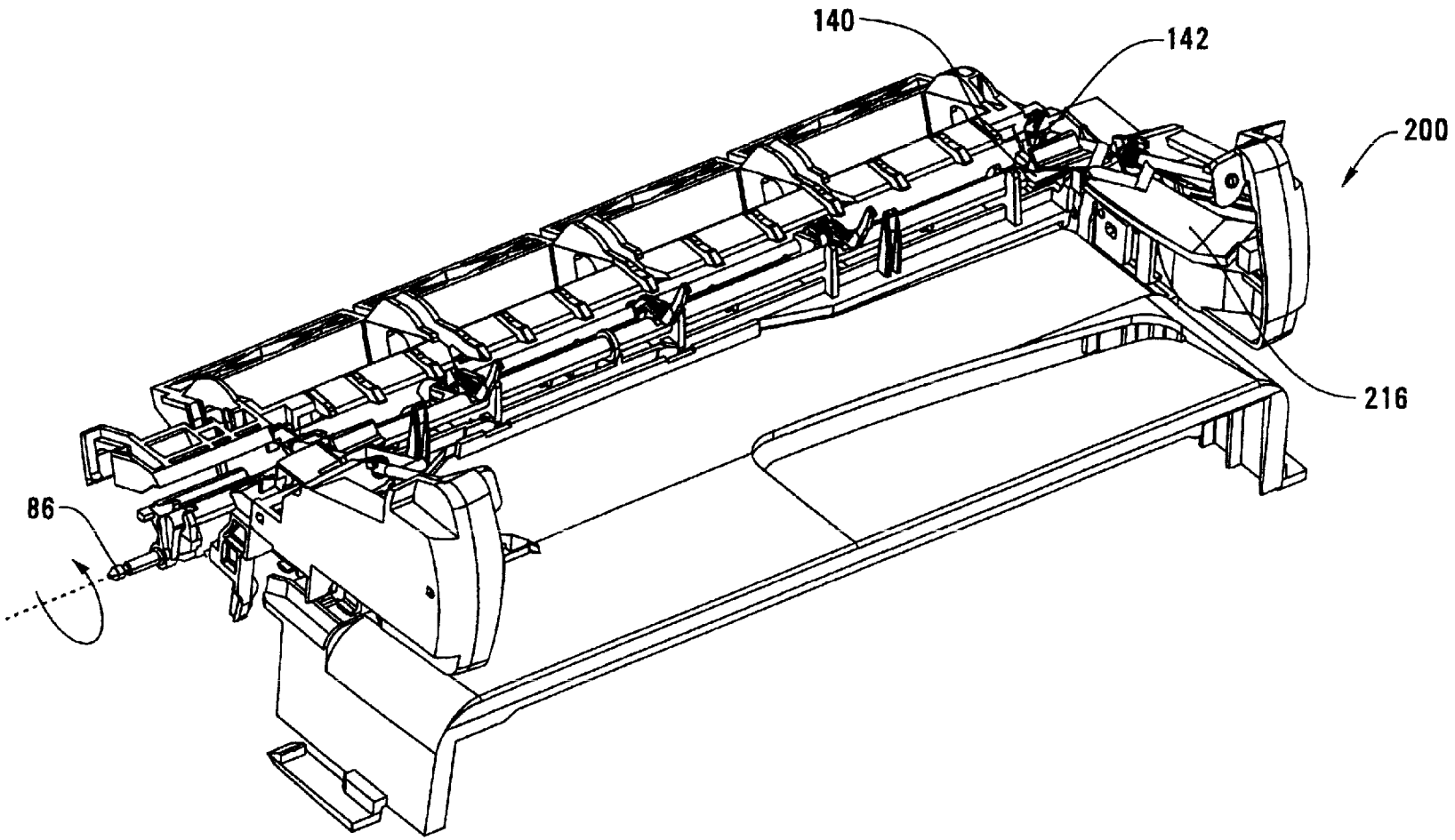
FIG. 6 illustrates the pivot mechanism rotating to a second position and the rail extensions in an activated position.

When a new print job starts, the pivot mechanism 86 rotates upward from its first position to a second position as shown in FIG. 6. Note that the end portion 140 is located under the respective lever portion 142 when the pivot mechanism 86 is in its first position (see FIG. 1). Thus, as the pivot mechanism 86 rotates upward to the second position, the end portion 140 drives the respective lever portion 142 upward. Consequently the actuator 210 is driven by the cam shaft 208 to rotate away from the respective wall 222. Each actuator 210 comes into contact with the outer blade 228 of the sleeve 214; pushes the outside blade 228 and consequently the wing structure 206 to move in a direction away from the wall 222. Since the tongues 220 are restricted to move linearly along the rails 212, the whole wing structure 206 including the wing 216 is driven to move substantially horizontally from the deactivated position away from the wall 222 to the activated position as shown in FIG. 4. That is, the wings of the two rail extensions both extend to receive a portion of the media sheet being printed. During printing, the pivot mechanism 86 stays in the second position as shown in FIG. 6. The end portion 140 prevents the respective lever portion 142 from rotating back such that the extended wings stay in the activated position to support two sides of the media sheet.

When the print job is over, the pivot mechanism 86 rotates downward back to its first position. With the end portion 140 to rotate downward, the lever portion 142 can slide on the surface of the respective end portion 140. Further, due to the bias force provided by the coil spring 145, the cam shaft 208 is now driven to rotate in a direction opposite to the one in which it rotates when the new print job starts. The cam shaft's rotation in turn drives the actuator 210 to rotate toward the wall 222 of the support frame 204. Consequently, the actuator 210 comes into contact with the inner blade 226 of the sleeve 214; further drives the inner blade 226 and consequently the wing structure 206 to move. Since the tongues 220 are restricted to move linearly along the rails 212, the whole wing structure 206 including the wing 216 is driven to move substantially horizontally toward the wall 222 to a deactivated position as shown in FIG. 5. As both of the wings are retracted, the printed media sheet which rests atop the wings is free to move to the output area.

As is apparently in the above-described embodiment, extra height is not needed to accommodate the rail extensions since the wing structures move horizontally during printing. This feature overcomes one of the disadvantages of the prior art.

The printing sequence has been described in '537, which has been incorporated by reference. In '537, however, the platen is part of the pivot mechanism and is also rotatable during printing.

What is claimed is:

1. An inkjet printer, comprising:

an inkjet cartridge having a printhead for printing to a media sheet;

a substantially linearly slidable support adjacent to the inkjet cartridge, wherein the support is substantially linearly slidable between a first position in which the support supports a portion of the media sheet when the media sheet is printed and fed toward a media output area, and a second position in which the media sheet is free to move to the media output area; and a support frame mounted on the printer, the support frame having a rail along which the support moves substantially horizontally.

2. The inkjet printer of claim 1, wherein the support includes a tongue for resting on and moving along the rail.

3. The inkjet printer of claim 2, wherein a print zone within which ink is printed onto the media sheet occurs between the printhead and the support, wherein the output area includes an output tray and the support includes a rail support mechanism which is located above the output tray and extends in the output area away from the print zone, and wherein the tongue is located at an end of the rail support mechanism.

4. The inkjet printer of claim 2, further comprising a driver for transferring a rotational driving force into a linear driving forcing such that the support is driven to move substantially horizontally between the first and second positions.

5. The inkjet printer of claim 4, wherein the driver includes a rotatable shaft for receiving the rotational driving force and an actuator which is connected to the shaft and extends away from the shaft, and wherein when the shaft is being rotated, the actuator drives the support to move substantially horizontally.

6. The inkjet printer of claim 5, wherein the support includes a sleeve for receiving the actuator.

7. The inkjet printer of claim 2, further comprising a bias mechanism for biasing the support towards the second position.

8. The inkjet printer of claim 7, further comprising:

a shaft for transferring a rotational driving force into a linear driving forcing such that the support is driven to move substantially horizontally between the first and second positions; and a support frame mounted on the printer;

wherein the bias mechanism includes a spring mounted on the shaft for biasing the support, and wherein the spring has an extended portion attached to a projection of the support frame.

* * * * *